United States Patent [19]

Silcott et al.

[11] 4,286,739

[45] Sep. 1, 1981

[54] CONVERTIBLE BACK PACK FRAME

[75] Inventors: Philip B. Silcott, McLean, Va.; James H. Stubbings, Rockville, Md.

[73] Assignee: Potomac Applied Mechanics, Bethesda, Md.

[21] Appl. No.: 55,369

[22] Filed: Jul. 6, 1979

[51] Int. Cl.[3] ..... A45F 4/00

[52] U.S. Cl. ..... 224/156; 224/153; 224/155

[58] Field of Search ..... 224/155, 156, 154, 923, 224/153

[56] References Cited

U.S. PATENT DOCUMENTS

| | | | |
|---|---|---|---|
| 1,615,159 | 1/1927 | Bönner | 224/155 |
| 2,133,717 | 10/1938 | Robes, Jr. | 5/343 |
| 2,401,986 | 6/1946 | Talbott | 280/41 |
| 2,843,185 | 7/1958 | Clem et al. | 155/150 |
| 2,922,465 | 1/1960 | Johansson et al. | 155/123 |
| 2,973,888 | 3/1961 | Beardsley | 224/156 X |
| 3,027,058 | 3/1962 | Huber | 224/155 |
| 3,158,299 | 11/1964 | Weir et al. | 224/153 |
| 3,241,734 | 3/1966 | Gray | 224/155 |
| 3,266,686 | 8/1966 | Griffith | 224/155 |
| 3,315,856 | 4/1967 | Black | 224/155 |
| 3,368,725 | 2/1968 | Martin | 224/155 |
| 3,620,428 | 11/1971 | Silverthorne | 224/156 |
| 3,730,294 | 5/1973 | Thurmond | 224/155 X |
| 3,822,813 | 7/1974 | Carter | 224/154 |
| 3,828,992 | 8/1974 | Cerchione | 224/156 |
| 3,846,855 | 11/1974 | Peterson | 224/156 X |
| 3,912,138 | 10/1975 | Pava | 224/156 X |
| 3,933,164 | 1/1976 | Ness et al. | 224/156 X |
| 4,056,857 | 11/1977 | Quantz | 224/156 X |

*Primary Examiner*—Steven M. Pollard

*Attorney, Agent, or Firm*—Cushman, Darby & Cushman

[57] ABSTRACT

A back pack frame that is convertible to a chair while still providing ready access to the pack supported by the frame, and is further convertible to a cot. A pack supporting structure with shoulder straps is mounted on a main support structure for linear movement along the main support structure, and so that it can be pivoted with respect to the main support structure to form a chair back, and further pivoted to form the head portion of a cot. User's legs support portions are telescopically received by the main support structure to provide leg supports for the chair or cot. Flexible fabric is mounted by rings to a bar of the main support structure, and is affixed to the pack supporting structure, so that upon movement of the pack supporting structure to the chair or cot orientation the fabric is drawn taut to form the seat portion of the chair, or middle portion of the cot.

26 Claims, 12 Drawing Figures

CONVERTIBLE BACK PACK FRAME

BACKGROUND AND SUMMARY OF THE INVENTION

The invention relates to a back pack frame which is readily utilizable for normal backpacking activities but may be readily converted into a chair or cot.

For many outdoor activities, it is desirable to be able to carry a wide variety of articles, clothing, food, and other provisions into areas that are not accessible by vehicles, and this conventionally is accomplished by disposing the articles, etc., in a pack which is mounted to a back pack frame. The back pack frame conventionally also mounts a bedroll, collapsible tent, or the like. When one eventually arrives at a destination where the packed articles, etc., are to be utilized, and especially when camping overnight, for comfort it is desirable that the individual be able to support himself off of the ground in a comfortable position. Also, it is desirable that the pack remains readily accessible.

According to the present invention, a back pack frame is provided that can readily be converted into a chair or cot so that the user can comfortably support himself off of the ground in a comfortable position. Also, according to the present invention, even while the frame is converted to a chair the pack remains supported thereby, and is readily accessible; and even when the frame is converted to a cot, the pack remains mounted thereto. The increased comfort provided by the convertible frame according to the invention is not achieved at the expense of utility of the frame for its basic pack-supporting structure. The back pack frame according to the invention can be constructed so that it is of only slightly greater dimension and weight than conventional frames for supporting packs of comparable size. For the average user, the versatility of the frame according to the invention, and the increased comfort achievable therewith, more than makes up for any small increase in weight or dimension as compared to conventional back pack frames.

The back pack frame according to the invention includes a main support structure, and a pack supporting structure with shoulder straps, with means for mounting the pack supporting structure with respect to the main support structure so that it is movable from a first position wherein it is generally coextensive with the main support structure to a second position wherein the main support structure forms a chair seat and the pack supporting structure forms the chair back. The front flap of the pack supported by the pack supporting structure is readily accessible when the frame is converted to a chair, being provided on the back of the chair back. The pack supporting structure may then be further moved to a position wherein it is substantially coplanar with the seat formed by the main support structure, and telescoping bars of a user's legs support structure can be moved outwardly from the main support structure to also provide an essentially coplanar support with the seat portion of the main support structure. The seat portion of the main support structure is formed by a flexible sheet of fabric mounted by rings onto side bars of the main support structure, and operatively attached to the pack supporting structure so that the rings slide along the bar to move the fabric to a taut position as the pack supporting structure is moved to the chair or cot forming position.

The main support structure includes first and second side support bars and a cross support structure extending between the side support bars. The second side support bar is substantially straight and the first bar is straight and parallel to the second bar over the majority of the length thereof, with the ends formed as arcs of a circle, and having extensions intersecting and connected to the second support bars, and then further extending away from the second support bars to provide legs. Collars are mounted for slidable movement along the first bars, and the collars may be retained in any position to which they are moved by suitable locking structures. The pack supporting frame is mounted for pivotal movement with respect to the collars, and rods extend outwardly from the ends of the pack supporting structure to be received by C-supports on the second support bars to allow guided pivotal movement of the pack supporting structure about the collar axes.

It is the primary object of the present invention to provide a back pack frame that is simply convertible to a chair and/or cot. This and other objects of the invention will become clear from an inspection of the detailed description of the invention, and from the appended claims.

BRIEF DESCRIPTION OF THE DRAWINGS

FIG. 4 is a perspective view of the structure of FIGS. 1 through 3 shown formed as a cot;

DETAILED DESCRIPTION OF THE DRAWINGS

Figure 1:
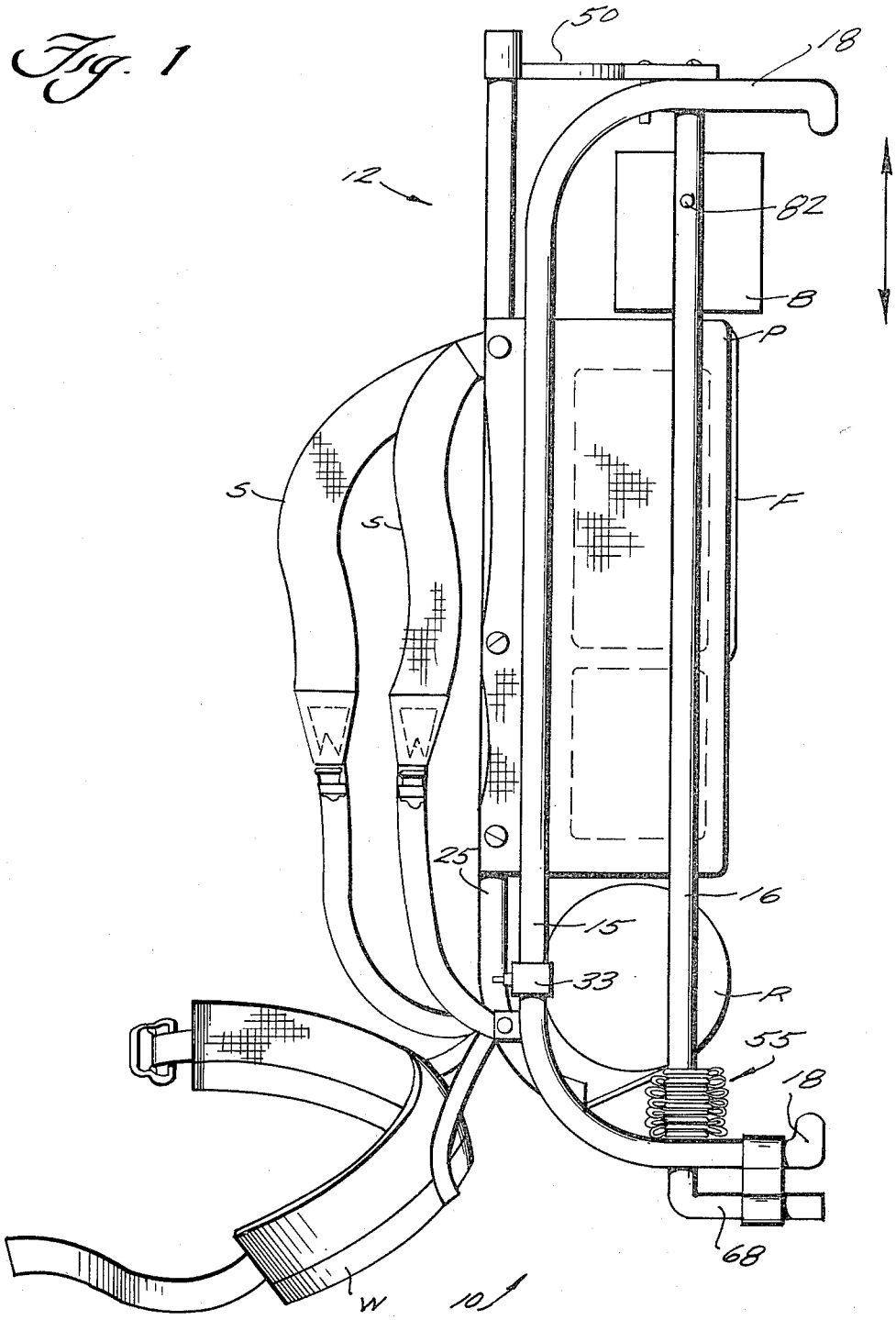
FIG. 1 is a side view of an exemplary back pack frame according to the invention illustrated in a position to be carried on a person's back.

An exemplary back pack frame according to the present invention is shown generally at 10 in the drawings. In the collapsed position thereof (FIG. 1), the frame 10 mounts a back pack P, with front flap F, and also can mount a conventional bedroll R and an insulated box B. Shoulder straps S and a waist strap W are connected to the frame 10 in any conventional manner, and are adapted to be disposed around the shoulders and hips of an individual utilizing the frame 10. The frame 10 is convertible to a chair (FIG. 3) having a seat and back rest, with the flap F of the pack P being mounted exteriorly of the chair sitting area so that the pack is readily accessible. The frame 10 is further movable to form a cot (FIG. 4).

The frame 10 according to the present invention includes two major components, a main support structure 11 and a pack supporting structure 12. The shoulder straps S and the waist strap W are operatively connected to the pack supporting structure 12 in any conventional manner.

The main support structure 11 preferably includes a pair of side supports including first side support bars 15, 15' and second side support bars 16, 16'. The bars 15, 15' are straight over the majority of the length thereof, and the second bars 16, 16' are also straight and parallel to the straight portions of the first bars. The ends 17, 17' of the first bars 15, 15' are formed as an arc of a circle, such ends 17, 17' providing interconnection between the first 15, 15' and second 16, 16' bars, and extensions thereof forming legs 18, 18'. The first and second support bars and legs of each side portion (i.e., 15, 16, and 18; 15', 16' and 18') are coplanar.

The main support structure further includes a pair of cross-supports including a cross-support 20 at the "front" end of the structure 11, and a cross-support 21 at the "rear" end thereof. Attached to the inside surface of each of the second bars 16, 16' is a C-shaped support 23, 23' (see FIGS. 5 and 6 in particular) which extend in a direction generally transverse to the plane of the main structure side support portions. The C-shaped supports are spaced a distance D (see FIG. 3) along the bars 16, 16' from the intersection thereof with the arcuate ends 17, 17' of the first side support bars 15, 15'. This distance D is equal to the radius of curvature of the circular arc portion (17, 17') of the first bar 15.

Figure 2:
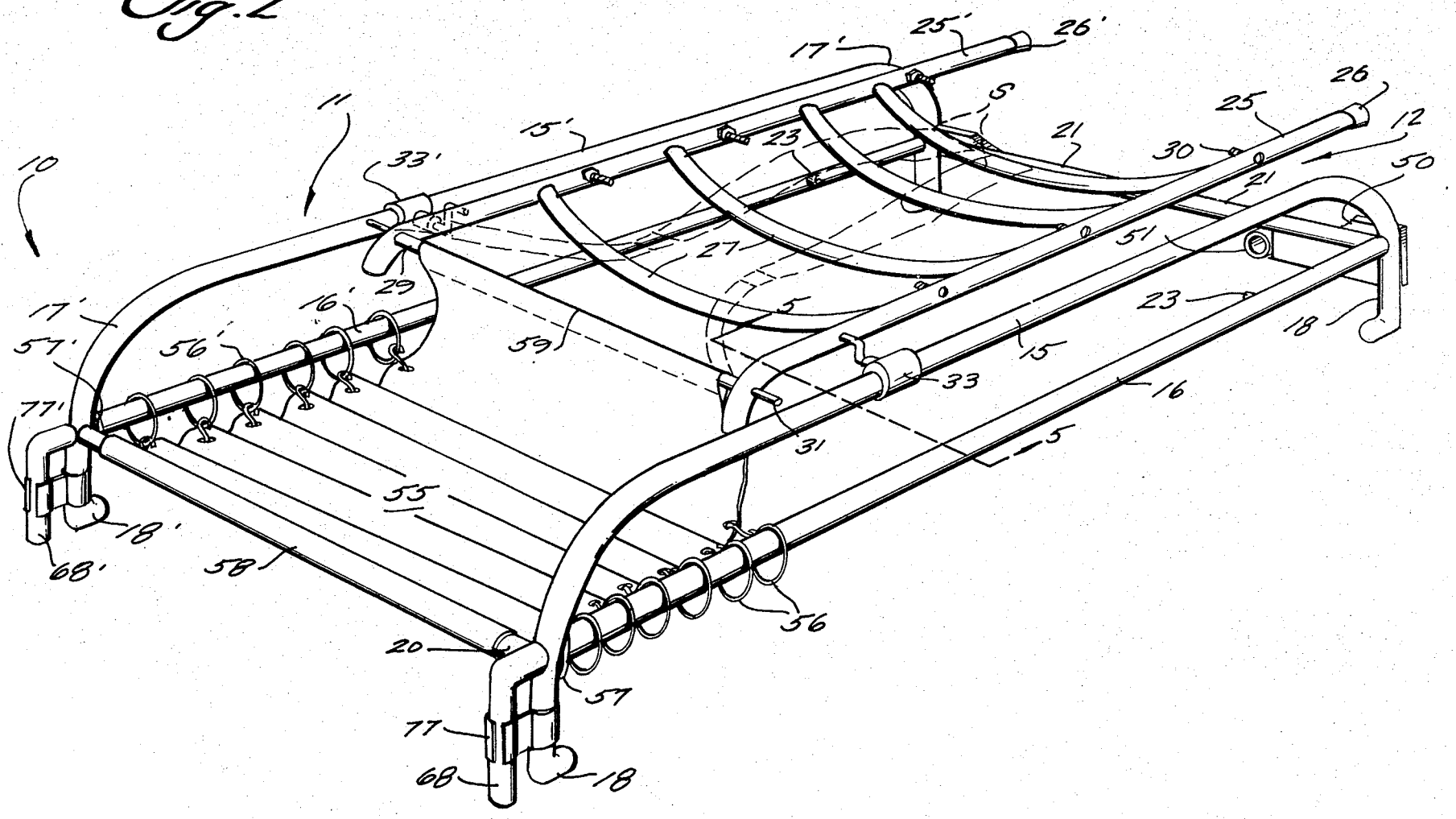
FIG. 2 is a perspective view of the frame of FIG. 1, with pack and other components removed for clarity, illustrating the frame in an intermediate position as it is being moved to form a chair.
Figure 9:
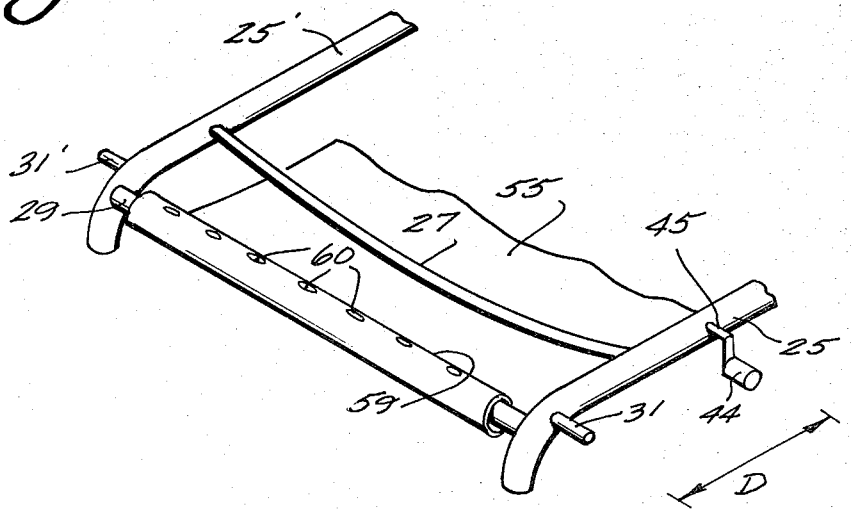
FIG. 9 is a detail view showing the releasable connection of the fabric chair seat to the pack supporting structure.
Figure 10:
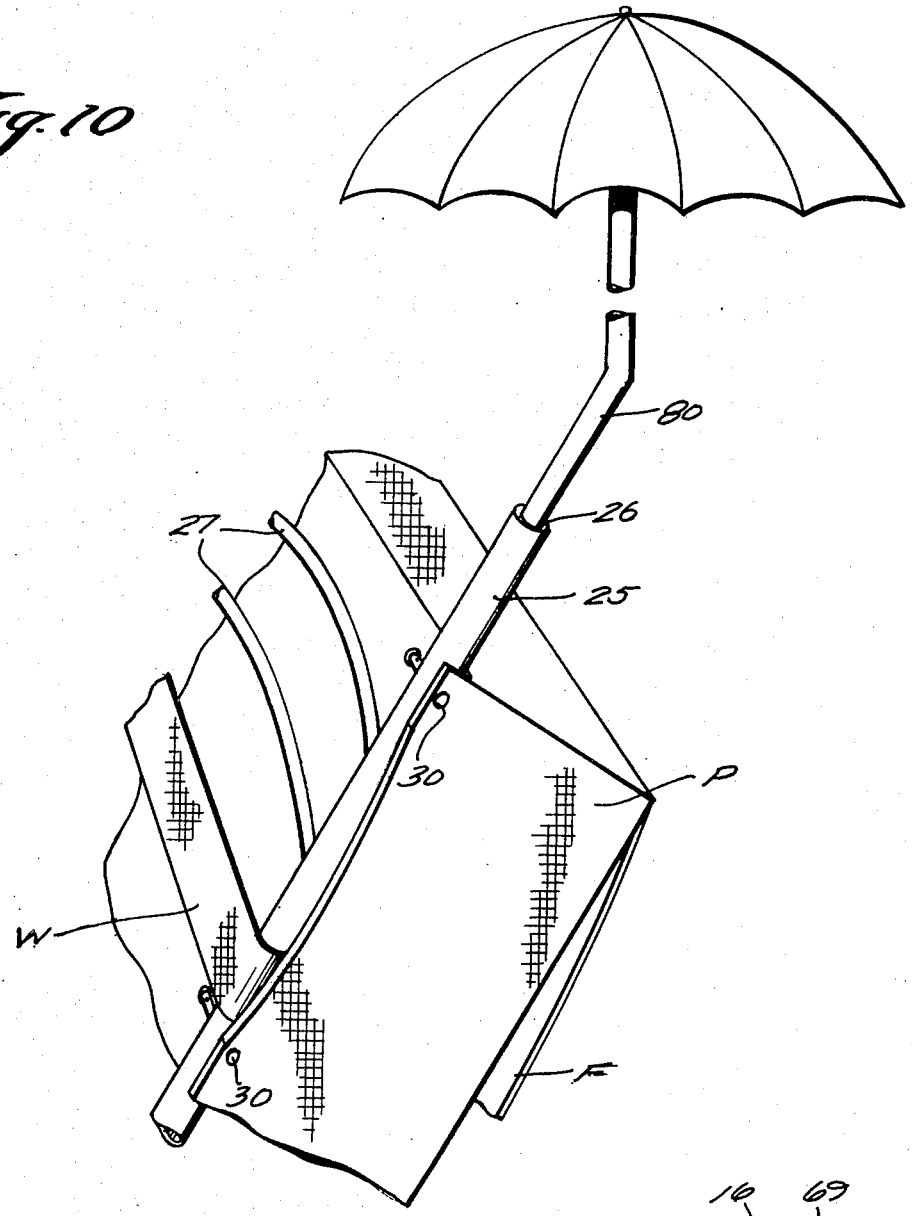
FIG. 10 is a detail perspective view illustrating the interconnection of a back pack to the pack supporting structure according to the invention.

The pack supporting structure 12 includes a pair of side bars 25, 25' having "top" ends 26, 26' thereof, and a plurality of cross-bars 27. At the "bottom" of the structure 12, a bottom cross-bar 29 (see FIGS. 2 and 9 in particular) is provided. The pack P is attached to the side bars 25, 25' at a plurality of points therealong, and such attachment may be accomplished utilizing removable conventional fasteners 30 with springkeepers, which pass through corresponding openings in the attachment portions of pack P and the side bars 25, 25' as indicated in FIG. 10. Additionally conventional webbing or mesh W may be provided extending between the side bars 25, 25', with the pack P having the front flap F thereof disposed exterior of the chair sitting area of the frame when in the chair-forming position (see FIG. 3), and being accessible from exterior the chair sitting area.

Means are provided for mounting the pack supporting structure 12 with respect to the main support structure 11 so that the structure 12 is always laterally within the side supports of the structure 11, and so that it is movable from a first position (FIG. 1) wherein it is generally within the volume defined by the structure 11, to a second position (FIGS. 3 and/or 4) where it is primarily without the volume defined by the structure 11, while so connected thereto. Such means preferably comprises a pair of collars 33, 33' surrounding each of the first side support bars 15, 15'. The collars are rather loosely disposed on the bars 15, 15' so that they are slidable along the circular arc portions 17, 17' thereof. Adjacent the last cross-bar 29 at the "front" end of the structure 12, a pair of outwardly extending rods 31, 31' (see FIG. 9) are provided. These rods cooperate with the C-shaped supports 23, 23' to provide a pivot point for rotation of the collars 33, 33', when moving along the arcuate portions 17, 17' of the first side support bars 15, 15'. Each pivot rod 31, 31' is spaced from the axis of rotation of its respective collar 33, 33' (shaft portion 45) a distance D corresponding to the radius of curvature of the circular arc portion 17, 17'.

Figure 7:
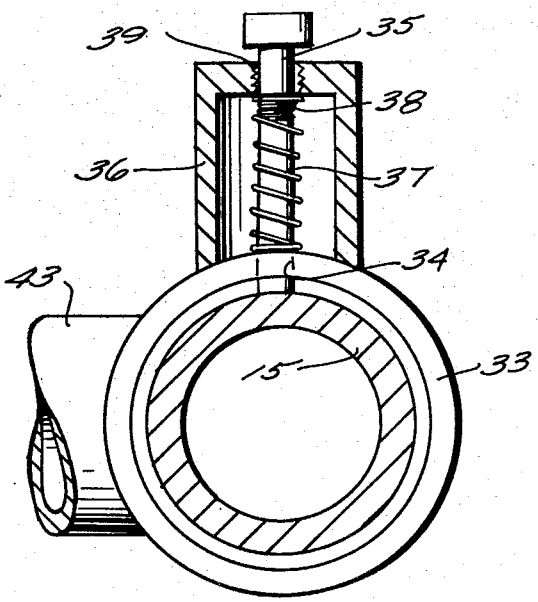
FIG. 7 is a detail end view of an exemplary collar locking mechanism utilizable with the frame of FIG. 1.

Means are also provided for selectively releasably locking each of the collars 33, 33' with respect to the side support bars 15, 15' with which it is associated. Such means may take the form of wing nuts, locking pins which penetrate the collars and side support bars, or which fit into indentations in the side support bars, or the like. One particularly desirable form such selective locking means can assume is illustrated most clearly in FIG. 7, and includes a radial bore 34 formed in the collar 33 in which a pin 35 can slide, within an upstanding guide portion 36 associated with the bore 34, and guiding movement of the pin 35 in the bore 34. Spring means 37, such as a conventional coil spring, are provided acting between the portion 36 and the pin 35 for biasing the pin 35 into frictional engagement with the bar 15 (or a plurality of holes or indentations may be provided in the bar 15 for cooperation with the pin 35). The spring 37 is strong enough and the frictional contact between the pin 35 and bar 15 is good enough so that the pin 35 will be maintained in locking engagement with the bar 15 unless the pin is moved against the pressure of spring 37. The pin 35 may be held in the non-locking position by cooperating threads 38, 39 formed on the pin 35 and guide 36, respectively.

Figure 5:
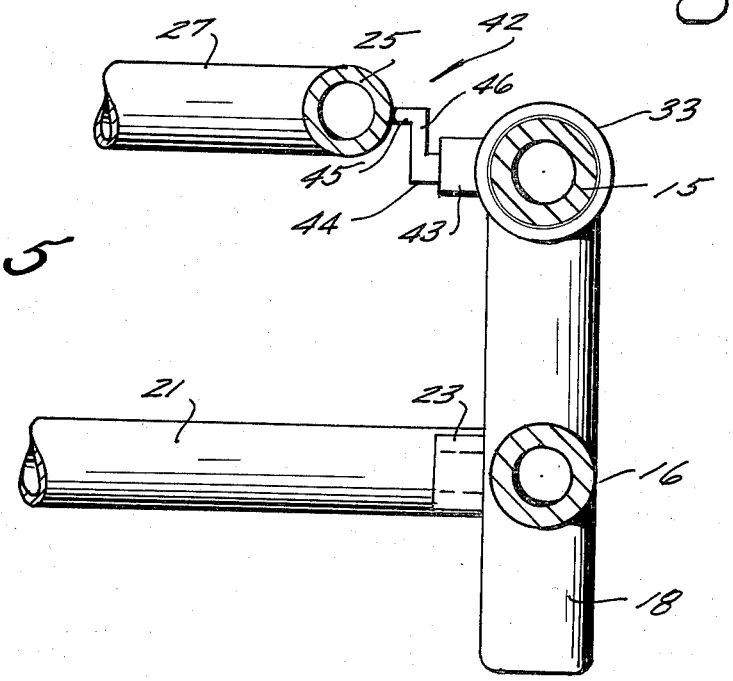
FIG. 5 is a cross-sectional view of one side of the structure of FIG. 2 taken along lines 5—5 thereof.
Figure 1:
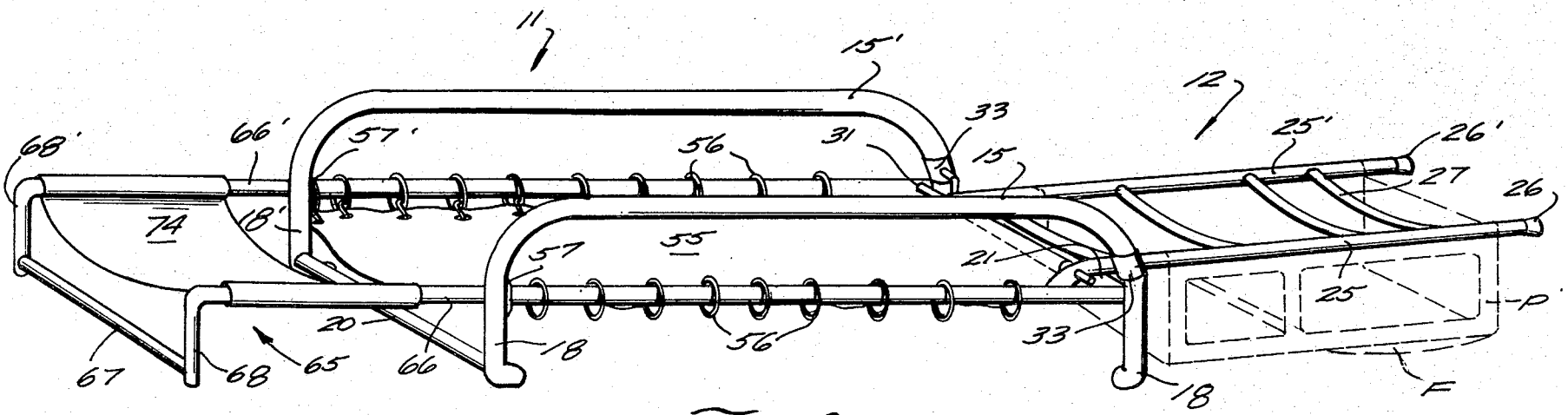
Figure 6:
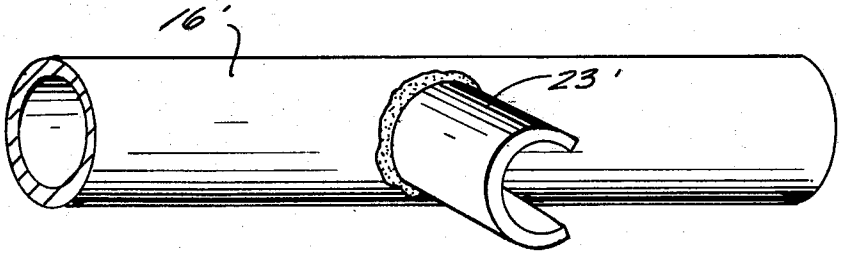
FIG. 6 is a detail perspective view of an exemplary pack supporting structure pivoting facilitating device according to the invention.

The mounting means for mounting the structure 12 with respect to the structure 11 further comprise shaft means 42 (see FIG. 5) including a shaft receiving bushing 43 extending inwardly from each collar 33, 33', and a shaft having one end portion 44 received by the portion 43, another end portion 45 rigidly attached to the pack supporting structure side bar with which it is associated (25, 25'), and a middle portion 46 transverse to the end portions 44, 45 so that the supporting bars 15, 25, 25', and 15' are essentially coplanar in the collapsed position of the frame 10 (FIGS. 1 and 5). The shaft portion 44 rotates with respect to the bushing 43 to allow pivotal movement of the pack supporting structure 12 with respect to the main support structure 11.

Figure 8:
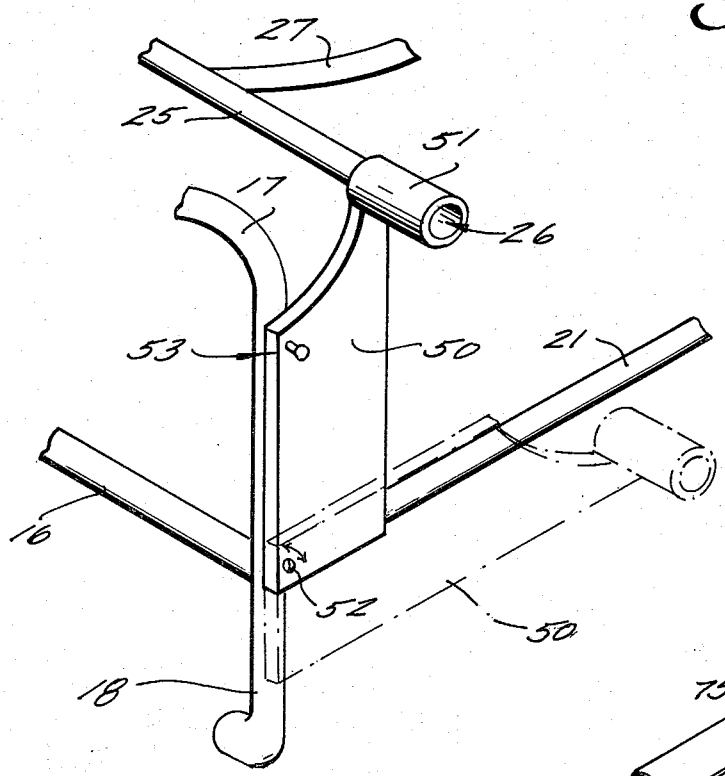
FIG. 8 is a detail perspective view of an exemplary structure for supporting an end of the pack supporting structure in collapsed position.

In order to support the structure 12 in the collapsed position with respect to the structure 11, in addition to the pins 35, a supporting structure for supporting the free ends 26, 26' of the structure 12 preferably is provided. An exemplary of such supporting structure is illustrated in FIG. 8, and comprises a plate 50 having an end portion 51 (e.g., tubular collar) for receiving a free end (26, 26') of the structure 12, the plate 50 being mounted for pivotal movement about pivot pin 52 attached to the leg portion 18 (or 18') of the main structure 11 at the "rear" end thereof, and including any conventional releasable locking means for holding the plate 50 in the solid line position in FIG. 8 to support the structure 12, and upon removal of the structure 53, allowing pivotal movement of the plate 50 (see dotted line position in FIG. 8) about the pivot 52 to a level below that of the cross rod 21.

According to the present invention flexible sheet means 55 also are provided, including means for mounting the flexible sheet means on the main support structure 11 and operatively attached to the pack supporting structure 12 for automatically moving the flexible sheet means from a collapsed position (FIGS. 1 and 2) to a taut position (FIGS. 3 and 4), wherein it defines the chair seat, upon movement of the structure 12 from the collapsed to the chair and/or cot-forming position. The means 55 preferably comprises a fabric sheet, the fabric preferably being one which will not substantially deform or elongate upon use (e.g., nylon or canvass). The mounting means preferably comprise a plurality of annular members (rings) 56, 56' encircling the second support bars 16, 16', respectively, and connected to opposed side edges of the sheet 55 as indicated in the drawings (see FIG. 2 in particular). The "front" edge 58 of the sheet 55 is held in a stationary position with respect to the structure 11, as by the front rings 57, 57' being welded to the bars 15, 16 and 15', 16', respectively. The trailing edge 59 (see FIGS. 2 and 9) of the sheet 55 is looped over the end cross-bar 29 of the pack supporting structure 12 and a plurality of snap fasteners 60 releasably hold the end 59 stationary with respect to the structure 12.

Figure 12:
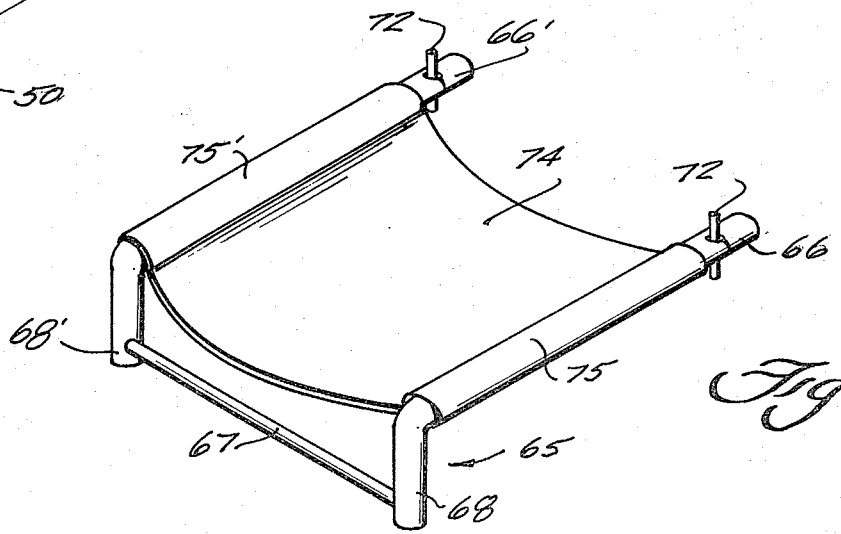
FIG. 12 is a perspective view of the user's legs support means according to the invention detached from the main support structure.
Figure 11:
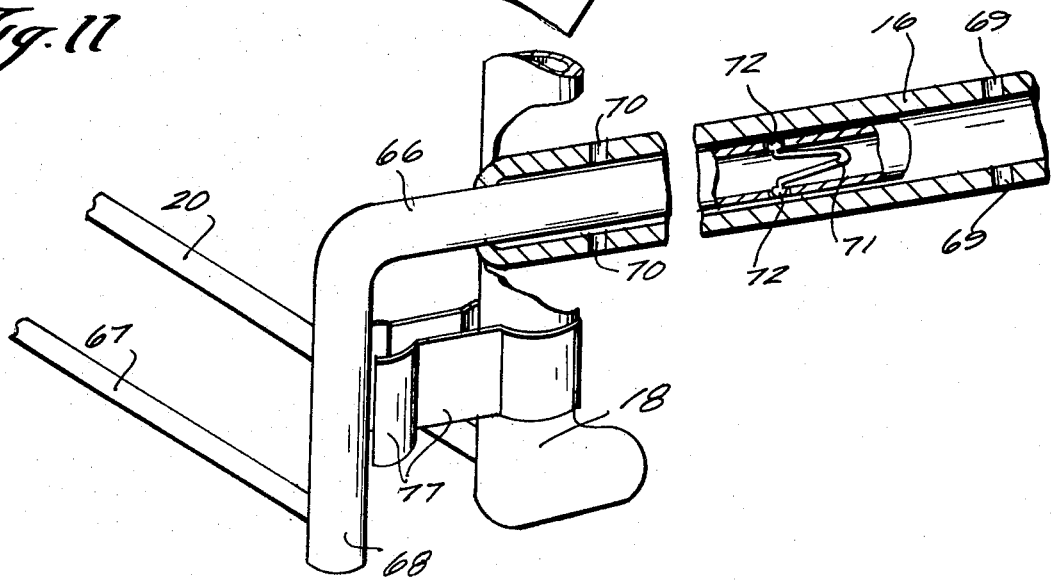
FIG. 11 is a detail perspective view, partly in cross-section, illustrating a telescopic arrangement between leg support means and the main support structure according to the invention.

The frame 10 also further preferably comprises user's legs support means 65 which include a pair of telescoping bars 66, 66' (see FIGS. 4 and 12 in particular), each having a leg 68, 68', respectively, extending substantially perpendicularly thereto and a cross-support 67 interconnecting the bars 66, 66' adjacent the legs 68, 68'. The second side support bars 16, 16' are preferably hollow with the bars 66, 66' being sized, and spaced apart by the side support 67, so that they are telescopically slidable within the hollow second side support bars 16, 16' (see FIG. 11 in particular). Detent means may be provided for maintaining the bars 66, 66' into positions to which they have been moved relative to the bars 16, 16'. Such detent means may take the form of openings 69, 70 (see FIG. 11) formed in the bars 16, 16' for cooperation with tip portions 72 of a detent spring 71 maintained within the hollow interior of the bars 66, 66'. The spring 71 forces the tips 72 radially outwardly through openings in the bar 66, 66' to engage the openings 69, 70 when in alignment therewith. A supporting fabric 74, which also may be of nylon or canvas, may be carried in the pack P and the tubular sides 75, 75' thereof may be slid over the bars 66, 66' (see FIG. 12) when the bars 66, 66' are removed completely from the bars 16, 16'. Spring clips 77, 77' (see FIGS. 2 and 11 in particular) may maintain the bars 66, 66' in their inward position (FIGS. 2 and 3) with respect to the bars 16, 16'.

If desired, at least one of the pack supporting structure side bars 25, 25' may be hollow, having an open end (e.g., 26 in FIG. 10) thereof adapted to receive a supporting stem 80 of an umbrella, so that an umbrella may cover an individual sitting in the chair, if desired. One or more removable fasteners 30 may be removed to allow insertion of the support 80; or the support 80 may normally be telescopically retained within the tube 25, the fasteners 30 being removable to allow withdrawal thereof.

The insulated box B (see FIG. 1) preferably has a length slightly less than the length of the cross-supports 20, 21, and is mounted adjacent the cross-support 21 to the second side support bars 16, 16' by conventional removable pivotal means 82, the pivotal means 82 allowing the box B to pivot about an axis transverse to the bars 16, 16' so that the center of gravity of the box B is always disposed in a vertical plane despite the orientation of the frame 10. The box B is removed when the frame 10 is moved to the cot-forming position (FIG. 4).

All of the components of the frame 10 preferably are formed of aluminum or other lightweight material, and all of the supporting structures (e.g., cross-supports 27, 20, 21; side supports 15, 16, 25, etc.) are preferably formed of light metal tubing.

Operation

A pack P is mounted to the side support bars 25, 25' of the structure 12 by a plurality of releasable fasteners 30, and a bedroll R and insulated box B are mounted to the structures 12, 11, respectively, with the frame 10 in the collapsed position (FIG. 1). In this position the pins 35 hold the collars 33 adjacent the "front" end of the frame 11 (adjacent cross-bar 20), and the receiving structures 51 of plates 50 hold the ends 26, 26' of the rods 25, 25' to prevent rotation thereof about the shaft portion 44 in bushing 43. An individual using the frame 10 then puts the straps 12 over his shoulders and the waist belt W around his waist, and can transport the frame 10 to any desired location.

Figure 3:
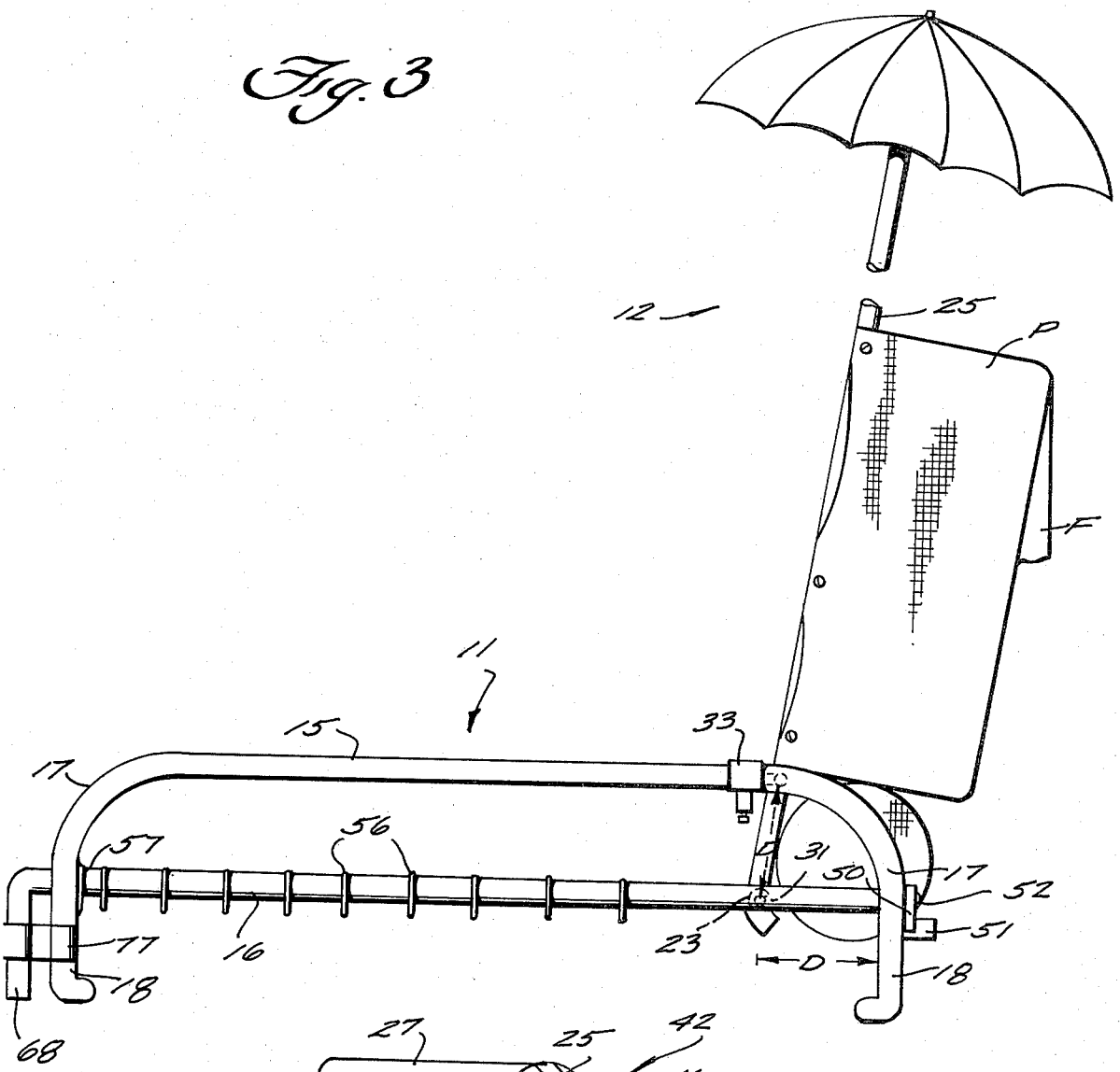
FIG. 3 is a side view of the structure of FIGS. 1 and 2 shown formed as a chair.

Once arriving at the desired location, the waist belt W is unfastened and the individual slips out of the shoulder straps S and places the frame 10 on the ground, with the legs 18, 18' in contact with the ground. One then pulls up on the pins 35 against the bias of springs 37, rotating them slightly so that the threads 38, 39 engage, and then the frame 12 may be linearly moved with respect to the frame 11 by the collars 33, 33' sliding along the first side support bars 15, 15', respectively. The free ends 26, 26' are removed from engagement with the tubes 51 before significant movement of the collars 33, 33' with respect to the support bars 15, 15'. Such relative movement is continued until the rods 31, 31' of the structure 12 pass over and are inserted into the C-shaped supports 23, 23', the proper angular orientation of the rods 25, 25' with respect to the rods 16, 16' is achieved, and the threads 38, 39' loosened so that the pins 35 are pressed into locking engagement with the bars 15, 15'. During such relative movement, the flexible sheet 55 is pulled taut by the relative movement of cross-support 29 with respect to the frame 11, the rings 56 sliding along the bars 16, 16'. The structure is then ready for use as a chair. The front flap F of the pack P is readily accessible with the device in the chair-forming position (FIG. 3).

The front flap F preferably is padded and may be folded over pack P to form a cushion over cross-supports 27, or may be supported by the user's head to form a sunshade.

When it is desirable to transform the frame 10 into a cot, the fasteners 53 are released, allowing pivotal movement of the plates 50 with respect to the legs 18, 18' to the dotted line position indicated in FIG. 8, and the pins 35 are again withdrawn from engagement with the bars 15, 15', and the collars 33, 33' slid along the arcuate portions 17, 17' of the bars 15, 15' to the position indicated in FIG. 4. The legs 68, 68' of the leg support means 65 are then detached from the spring clip 77, 77', and the telescoping bars 66, 66' removed from the tubes 16, 16' and the tubular ends 75, 75' of the cloth 74 inserted over the telescoping bars 66, 66'. Then the bars 66, 66' are reinserted in the tubes 16, 16' until the detent ends 72 engage the openings 70 in the tubes 16, 16' (see FIGS. 4 and 11). In this position, the head and back portion of the cot is formed by the pack supporting structure 12, the seat support of the cot is provided by the sheet 55, and the leg support is provided by the sheet 74, all of these portions being substantially coplanar.

To collapse the structure, the reverse steps are followed.

Thus, it will be seen that according to the present invention a back pack frame has been provided which is simply convertible into a chair and/or cot, providing a sturdy, comfortable device for maintaining an individual off the ground while not detracting from the primary back-pack frame functioning thereof. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A back pack frame comprising (a) a main support structure including a pair of side supports, and a pair of cross-supports extending between said side supports; each said side support including (i) first and (ii) second side support bars, said second bar being substantially straight, and said first bar being straight and substantially parallel to said second bar over the majority of the length thereof, (iii) a pair of interconnecting bars rigidly interconnecting said first and second side support bars and fixing the relationship therebetween, and (iv) a pair of legs extending from said second bar away from said first bar, said legs and interconnecting bars being in fixed position relative to each other disposed in a common plane with said first and second bars; and (b) a pack supporting structure including shoulder straps for mounting said frame on a person's shoulders; and (c) means for mounting said pack supporting structure with respect to said main support structure so that said pack supporting structure is always laterally within said side supports of said main support structure, and so that it is movable from a first position wherein it is generally within the volume defined by said main support structure, to a second position wherein it is primarily without the volume defined by said main support structure, while still connected thereto.

2. A back pack frame comprising (a) a main support structure including a pair of side supports, and a pair of cross-supports extending between said side supports; each said side support including (i) first and (ii) second side support bars, said second bar being substantially straight, and said first bar being straight and substantially parallel to said second bar over the majority of the length thereof, (iii) a pair of interconnecting bars interconnecting said first and second side support bars, and (iv) a pair of legs extending from said second bar away from said first bar, said legs and interconnecting bars being disposed in a common plane with said first and second bars; and (b) a pack supporting structure including shoulder straps for mounting said frame on a person's shoulders; and (c) means for mounting said pack supporting structure with respect to said main support structure so that said pack supporting structure is always laterally within said side supports of said main support structure, and so that it is movable from a first position wherein it is generally within the volume defined by said main support structure, to a second position wherein it is primarily without the volume defined by said main support structure, while still connected thereto, said mounting means comprising: a collar that surrounds and is slidable with respect to each said first side support bars; means for selectively releasably preventing movement of each of said collars with respect to said first side support bar with which it is associated; and means for mounting said pack supporting structure for rotation with respect to said collars about an axis generally transverse to said side support bars.

3. A back pack frame as recited in claim 2 further comprising a sheet of flexible sheet material having a pair of opposed parallel side edges; and means for mounting said parallel edges with respect to said second side support bars so that said flexible sheet material extends between said second side supports bars; said mounting means including a plurality of annular members attached to said sheet edges, each encircling a said second side support bar and slidable along said second side support bars so that said flexible sheet may be moved from a position wherein it is collapsed, with said annular members associated with each second side support bar substantially abutting each other, to a position wherein it is taut in the direction of elongation of said side support bars, with said annular members spaced from each other.

4. A back pack frame as recited in claim 2 wherein each of said first side support bars is formed as an arc of a circle at the ends thereof, and provides said interconnecting bars, and has continuations which provide said legs.

5. A back pack frame as recited in claim 4 further comprising means facilitating pivotal movement of said collars with respect to said second side support bars, said collars travelling along respective end portions of said first side support bars formed as an arc of a circle during pivotal movement thereof; said pivotal movement facilitating means comprising a C-shaped support fastened to each of said second side support bars, and a pivot rod extending outwardly from each side of said pack supporting structure for receipt by said C-shaped support; each said C-shaped support being spaced along its respective said second side support bar a distance, corresponding to the radius of curvature of said circular arc portion of its respective first side support bar, from the intersection of said first side support bar and said second side support bar, and each said pivot rod being spaced from the axis of rotation of its respective collar with respect to said pack supporting structure, a distance corresponding to the radius of curvature of said circular arc portion.

6. A back pack frame as recited in claim 3 further comprising means for releasably connecting an edge of said flexible sheet material that is perpendicular to said opposed parallel side edges to said pack supporting structure so that it is slidable with said pack supporting structure.

7. A back pack frame as recited in claims 1 or 5 wherein each of said second side support bars is hollow, and further comprising a pair of telescoping bars, a leg extending substantially perpendicularly to each of said telescoping bars, and a cross-support interconnecting said telescoping bars adjacent said legs, said telescoping bars being sized, and spaced apart by said cross-support, so that they are telescopically slidable within said hollow second side support bars.

8. A back pack frame that is convertible into a chair having a seat and a back defining a chair sitting area, said frame comprising a main support structure;

a pack supporting structure for supporting a pack having a front flap, the front flap of the pack being disposed on the opposite side of said pack supporting structure as shoulder straps attached to the pack supporting structure for mounting said frame on a person's shoulders; and means for mounting said pack supporting structure with respect to said main support structure so that said pack supporting structure is movable from a first position wherein it is generally coextensive with said main support structure, to a second position wherein said main support structure forms the chair seat, and said pack supporting structure forms the chair back with said shoulder straps mounting side of said pack supporting structure being disposed within the chair sitting area, and said pack front flap being disposed exterior the chair sitting area and accessible from exterior the chair sitting area with the frame in the chair-forming position.

9. A frame as recited in claim 8 further comprising user's legs support means, and means for mounting said user's legs support means to said main support structure so that they are movable from a first position wherein they are substantially coextensive with said main support structure to a second position wherein they extend outwardly from said main support on the opposite end thereof as the chair back formed by said pack supporting structure.

10. A frame as recited in claim 9 wherein said means for mounting said pack supporting structure with respect to said main support structure further comprises means for mounting said pack supporting structure so that it is movable to a third position wherein it forms a support surface substantially coextensive with said seat portion and said user's legs support means.

11. A back pack frame that is convertible into a chair having a seat and a back; said frame comprising a main support structure;

a pack supporting structure for supporting a pack, and including shoulder straps for mounting said frame on a person's shoulders;

means for mounting said pack supporting structure with respect to said main support structure so that said pack supporting structure is movable from a first position wherein it is generally coextensive with said main support structure, to a second position wherein said main support structure forms the chair seat and said pack supporting structure forms the chair back; and flexible sheet means, and means for mounting said flexible sheet means on said main support structure and operatively attached to said pack supporting structure for automatically moving said flexible sheet means from a collapsed position to a taut position, wherein it defines the chair seat, upon movement of said pack supporting structure from said first position to said second position.

12. A back pack frame as recited in claim 11 wherein said main support structure includes a pair of parallel side bars, and wherein said means for mounting said flexible sheet means comprises a plurality of annular members surrounding each side bar and slidable with respect thereto, and operatively attached to said flexible sheet means, and means for immovably affixing one end of said flexible sheet means to said main support structure, and means for immovably affixing the other end of said flexible sheet means to said pack supporting structure.

13. A back pack frame as recited in claim 12 wherein said pack supporting structure includes a cross-bar, and wherein said means for immovably affixing the other end of said flexible sheet means to said pack supporting structure comprises a plurality of snap fasteners formed on the other end of said flexible sheet means so that it encircles said cross-bar and snaps in position.

14. A pack frame comprising:

(a) a main support structure including:

a pair of side supports;

a pair of cross-supports extending between said side supports;

each said side supports including a first support bar, each said first bar being straight over the majority of the length thereof, and having the ends thereof formed as an arc of a circle and having extensions extending perpendicular to the straight portion thereof and forming legs, said first bar and leg extensions of each side support being coplanar;

(b) a pack supporting structure including a pair of side bars and a plurality of cross-bars;

(c) a collar surrounding and slidable with respect to each first bar, and including means for releasably preventing movement of each of said collars with respect to said first side support bar with which it is associated;

(d) shaft means for mounting each pack supporting structure side bar for slidable movement with, and rotation, about an axis transverse to said side support bars, with respect to said collars;

(e) flexible sheet means; and (f) means for operatively mounting said flexible sheet means to said main support structure for movement generally with said pack supporting structure.

15. A frame as recited in claim 14, wherein said main support structure side supports each further comprises a second substantially straight support bar, each first bar straight portion being parallel to its respective second bar, with said first bar ends intersecting said second bar and said leg extensions extending away from said second bar, each respective side support first and second bars and leg extensions being coplanar; and said frame further comprising means facilitating pivotal movement of said collars with respect to said second side support bars, said collars travelling along respective end portions of said first side support bars formed as an arc of a circle during pivotal movement thereof; said pivotal movement facilitating means comprises a C-shaped support fastened to each of said second side support bars and a pivot rod extending outwardly from each side of said pack supporting structure for receipt by said C-shaped support; each said C-shaped support being spaced along its respective said second side support bar a distance corresponding to the radius of curvature of said circular arc portion of its respective first side support bar, from the intersection of said first side support bar and said second side support bar, and each said pivot rod being spaced from the axis of rotation of its respective collar with respect to said pack supporting structure a distance corresponding to the radius of curvature of said circular arc portion.

16. A frame as recited in claim 15 wherein said means for operatively mounting said flexible sheet means to said main support structure comprises a plurality of annular members surrounding said second support bars and attached to said flexible sheet means, and means for releasably attaching said flexible sheet means to said pack supporting structure.

17. A frame as recited in claim 15 further comprising an accessory box having a length less than the length of said cross-supports extending between said main support structure side supports; and further comprising means for pivotally mounting said box to said second support bars so that said box will always assume a position wherein its center of gravity is in a vertical plane passing through said pivotally mounting means despite the relative orientation of said main support structure with respect to the ground.

18. A frame as recited in claim 16 further comprising means for releasably supporting ends of said pack supporting structure side bars remote from said collars; said releasable supporting means including a pair of plates having side bar end-receiving portions, each plate being pivotally mounted with respect to a first side support bar leg extension.

19. A frame as recited in claim 16 wherein said second side support bars are hollow; and wherein said frame further comprises a pair of telescoping bars, a leg extending substantially perpendicularly to each of said telescoping bars, and a cross-support interconnecting said telescoping bars adjacent said legs, said telescoping bars being sized, and spaced apart by said cross-support, so that they are telescopically slidable within said hollow second side support bars.

20. A frame as recited in claim 19 further comprising a piece of flexible sheet material having opposite sides formed as tubes sized to receive said telescoping bars, and having a width corresponding to the spacing between said telescoping bars.

21. A frame as recited in claim 19 wherein said telescoping bars and said second side support bars include detent means for releasably retaining said telescoping bars in predetermined positions with respect to said second side support bars.

22. A frame as recited in claim 16 wherein at least one of said pack supporting structure side bars is hollow and open-ended; and further comprising an umbrella supporting rod sized so as to be insertable in the open end of said pack supporting structure hollow side bar.

23. A frame as recited in claim 14 wherein said shaft means include two substantially parallel end portions and a transverse middle portion.

24. A frame as recited in claim 14, and further comprising a pack, and means for releasably mounting said pack to said pack supporting structure side bars at a plurality of distinct locations along each.

25. A frame as recited in claim 14 wherein said means for releasably preventing movement of each of said collars with respect to said first side support bar with which it is associated comprises a pin, a guide structure for said pin upstanding from the exterior of said collar, and coextensive with a radial bore formed in said collar, and spring means for pressing said pin through said radial bore and into engagement with said first bar received by said collar.

26. A frame as recited in claim 25 wherein each said collar movement preventing means further includes means for locking said pin out of engagement with said first side support bar against the bias of said spring means.

* * * * *